United States Patent [19]

Ignashev et al.

[11] 4,129,027

[45] Dec. 12, 1978

[54] APPARATUS FOR MAKING METAL STRIP

[76] Inventors: Evgeny P. Ignashev, ulitsa Korzhenevskogo, 13, kv. 85, Minsk, U.S.S.R.; Evmeny G. Konovalov, deceased, late of Minsk, U.S.S.R.; by Georgy E. Konovalov, administrator, ulitsa Akademicheskaya, 13, kv. 20, Minsk; by Nina E. Zaitseva, administrator, prospekt Kosmonavtov, 92, kv. 92, Leningrad, both of U.S.S.R.

[21] Appl. No.: 815,782

[22] Filed: Jul. 14, 1977

[51] Int. Cl.[2] ..... B21J 7/20

[52] U.S. Cl. ..... 72/429; 72/DIG. 20

[58] Field of Search ..... 72/56, 57, 429, 430, 72/DIG. 20; 228/1; 29/243, 54

[56] References Cited

U.S. PATENT DOCUMENTS

| | | | |
|---|---|---|---|
| 3,106,856 | 10/1963 | Jones | 228/1 |
| 3,201,967 | 8/1965 | Balamuth | 29/243.54 |
| 3,341,935 | 9/1967 | Balamuth | 228/1 |
| 3,495,427 | 2/1970 | Balamuth | 72/56 |
| 3,609,851 | 10/1971 | McMaster | 29/243.54 |
| 3,695,500 | 10/1972 | Walraven | 228/1 |

*Primary Examiner*—C.W. Lanham
*Assistant Examiner*—Gene P. Crosby
*Attorney, Agent, or Firm*—Fleit & Jacobson

[57] ABSTRACT

An apparatus comprises working tools — a hammer and an anvil. A concentrator of ultrasonic oscillations is in an intimate contact with the hammer, and the anvil is mounted on an end face of a metal rod of a length which is multiple to one quarter of ultrasonic wavelength. The rod is vertically adjustable relative to the hammer.

3 Claims, 4 Drawing Figures

APPARATUS FOR MAKING METAL STRIP

The invention relates to metal forming, and more particularly to an apparatus for making metal strip.

The invention may be most advantageously used for obtaining narrow strips of micron thickness, including superthin strips of any metals and alloys.

In modern instrumentation, including the electronic instrumentation, narrow strips of micron thickness are in evergrowing demand for making various critical parts of instruments, such as torque springs for mechanical measuring heads, braces for electric measuring instruments, control structures in travelling, wave valves, conducting elements for gyroscopes and airborne vehicles, metal tapes for magnetic recording systems and many other components of instruments. At the same time, the modern trend to microminiaturization in the field unavoidably results in the need of using, for the manufacture of the above-mentioned components of instruments, thinner and thinner narrow strip of 0.001 to 0.005 mm thick of hard and high-strength, hence hard-to-deform metals and alloys. In many cases, for instance in the manufacture of braces for electrical measuring instruments and torque springs, the ratio of strip width to its thickness should be at least 10.

Known equipment for making such strips does not comply with the above requirements. At present, two- and multiroll mills, mills with idle rolls or rolling mills using balls as deforming working tools are employed to produce narrow micron thickness strips. In rolling thin strips of hard-to-deform metals on smooth rolls high specific pressures are developed due to deformation forces acting over a very small area of the deformation source at the points of contact of the wire with the rolls thus resulting in rapid failure of rolls and manufacture of strips having unsquare cross-section, substantial non-uniformity of thickness over the entire length and low quality of the strip surface. Better results are obtained in rolling wire without heating using hard-alloy rolls of tungsten carbide having elastic modulus three times higher than that of steel. But the rolls life is short, especially in machining such hard-to-deform metals as molybdenum, rhenium, tungsten and their alloys. High-grade narrow strips with strict thickness tolerance and with a surface finish better than Class 10 cannot be practically made by rolling such materials. In order to improve plasticity of refractory metals, in certain cases rolling is effected with wire heating up to 300°–400° C., that is a so called warm rolling is used. This results, however, on the one hand, in oxidation of the strip surface, and on the other hand, in great differences in thickness due to unstable thermal conditions for the rolling mill elements (rolls, bearings, frame and the like) which effect the accuracy of the strips as regards thickness. In order to eliminate temperature-dependent changes in size of said elements of the rolling mill, the rolls should be thermally stabilized, or even the rolling mill is to be thermally controlled, as a whole which makes its construction very complicated. Accuracy and quality of rolling in multiroll rolling mills depend on the accuracy of manufacture of all components and assemblies of the mill, especially of the roll system. It is known that with an increase in the number of rolls in a multiroll mill, which is necessary and complementary to impart rigidity to the roll system and obtain superthin strips, the accuracy of rolling is always impaired. Unavoidable accumulated error in the manufacture of assemblies of a multiroll rolling mill also results in flaws at overdraft of wire. Rolling mills with idle rolls for obtaining narrow micron thickness strip are practically out of use due to a low aspect ratio which depends on the strength of the metal being rolled. When rolling mills having working rolls in the form of balls are used, the strip produced is made of biconcave section.

Therefore, it is extremely difficult, if at all possible, to obtain superthin narrow strips of 0.01 to 0.005 mm thick through rolling. The productivity when rolling strip from wire using the equipment available is rather unadequate and is as low as 20 m/min. An increase in speed results in additional difficulties due to wear of bearings and shaft journals, as well as heating of rotating parts of the rolling mill, hence in the need of thermal control of the rolling mill. Still another disadvantage of the rolling of narrow strips on cylindrical rolls resides in that it is not possible to obtain narrow micron thickness strips with profiled cross-section. Mandatory use of lubricants during rolling requires an additional step for cleaning the strip surface from residues of lubricant which may result in deterioration of the strip.

The above disadvantages are partially eliminated by the use of a method of ultrasonic spreading (cf. USSR Inventor's Certificate No. 313593, Cl B 21 21/00). In accordance with this method, wire is passed between two dies — a hammer and an anvil — of which one die — anvil — is secured to a frame and the other die — hammer — receives ultrasonic oscillations. The wire which has passed between the dies is rewound from one spool to another. Due to oscillations at ultrasonic frequency imparted to the end face of the hammer the deformation of the wire into strip takes place.

The disadvantage of the known method is that both dies are fixed in such a manner that accurate measurement and adjustment of the gap therebetween are not possible which hampers the manufacture of micron thickness strips. In addition, the problem of fastening the anvil so as to ensure the preservation of resonance system of acoustic waves during operation was not solved. When the anvil is mounted on a support of an arbitrary height, and hard metal wire with elevated resistance to deformation is deformed into a strip a certain reduction in amplitude and frequency of hammer oscillations may occur, the anvil mass and the mass of the support are progressively added to the concentrator through the work surface, the node of ultrasonic standing wave is shifted, the acoustic system is out of resonance, and losses of ultrasonic energy occur due to leakage to the base of the apparatus. This results either in considerable decrease in the productivity of the strip manufacture or in difficulties in carrying out the process since an increase of the traction force is required for winding the strip. With an abrupt reduction of amplitude of the hammer oscillations, the force of traction applied to the strip becomes equal to the strip strength thus resulting in breakage of the strip.

It is an object of the invention to provide narrow metal strips of micron thickness having high quality as regards thickness and surface finish.

Another object of the invention is to simplify the manufacturing process in making metal strips of micron thickness of any metals and alloys.

Further object of the invention is to achieve high productivity in making metal strip.

Still another object of the invention is to eliminate contamination of the metal strip surface with lubricants.

The above and other objects are accomplished by that in an apparatus for making metal strip comprising working tools — a hammer and an anvil which is mounted on a support, a source of ultrasonic oscillations having a concentrator in contact with the hammer, feeding and receiving spools for wire and strip, respectively, and a wire tensioning mechanism, according to the invention, the support comprises a metal rod having an end face supporting the anvil, the rod being vertically adjustable relative to the hammer and the rod length being multiple to one quarter of ultrasonic wavelength.

The use of the apparatus according to the invention enables complete replacement of rolling mills employed for the manufacture of narrow micron thickness strips made of any metals and alloys from wire of 0.3 mm diameter and less. Simultaneous action of acoustic and impact loads on the wire being deformed results in lowering of ultimate elasticity of the wire metal, improves its plasticity and reduces total deformation force by 3–4 times, while the specific pressure is reduces by 5–6 times thus resulting in 20–30 times improvement of life of the working tools as compared to those in the rolling mills, and in considerable reduction of size of the apparatus. The productivity of ultrasonic spreading depends on frequency of ultrasonic oscillations and shape of the working portions of the working tools (hammer and anvil), and this productivity is 10–20 times greater than that of rolling mills for the same dimensions of narrow micron thickness strips. Actually the productivity is still higher because the aspect ratio for wire upon a single pass may achieve 60–90% depending on the wire material. As the working surfaces of the tools are practically spaced apart from the strip surface at every half-cycle of oscillations, that is they are not in contact therewith, air functions as lubricant thus eliminating the need in using other special lubricants. This means that such labour-consuming operation as cleaning of the finished strip from contaminants and lubricant, which are inadmissible for the majority of components for radio and electronic instruments, is dispensed with. Since only one rather small portion of wire is a very short time period equal to about $1.10^{-3}$–$1.10^{-5}$ s, in the deformation zone at an average traction speed of 50–60 m/min no substantial heating, hence oxidation of wire during ultrasonic treatment occurs. This was experimentally confirmed by obtaining micron thickness strips of platinum, molybdenum, nickel, molybdenum and rhenium alloys, copper, tin and berrilium bronze, aluminium, bimetallic wire with the upper layer made of silver or tin, and other metals and alloys.. The use of the apparatus according to the invention enables the production of micron thickness strips of high quality surface finish (not worse than Class 12) irrespective of the wire surface finish which means the smoothing of surface irregularities and elimination of surface defects was attained. The apparatus according to the invention is used for obtaining superthin strips of 0.005–0.002 mm thick, as well as microstrips with profiled cross-section which was impossible in the conventional apparatus. This offers new prospects in the field of microminiaturization of instruments. The apparatus according to the invention enables the production of microstrips with negligible difference in thickness along the entire length.

In accordance with one embodiment, the apparatus is provided with a device for damping ultrasonic oscillations induced in the anvil during the manufacture of metal strip, the device comprising a metal sleeve having an end face receiving the metal rod in such a manner that the upper end face of the rod is aligned with the end face of the sleeve which is closed at the bottom by a metal plug supporting the sleeve on an adjusting wedge for vertical displacement of the anvil, the lengths of the rod and sleeve differing from each other by an odd number of quarters of ultrasonic wavelength. This construction of the apparatus is very efficient to improve the reliability of the apparatus operating on continuous basis. In this case, ultrasonic waves transmitted through the wire being treated propagate both in the sleeve and rod, the ultrasonic waves passing through these elements being completely reflected and propagating in the opposite direction. Since the lengths of the sleeve and rod differ from each other by an odd number of quarters of ultrasonic wavelength, the reflected waves reach the anvil with a phase shift of $\pi/2$ to be mutually damped. Thus the presence of ultrasonic standing waves in the sleeve and rod is substantially eliminated to provide for a stable resonance performance of the converter/concentrator/hammer system. The absence of oscillations of the rod and anvil in the standing-wave mode eliminates the possibility of beat in the zone of plastic deformation which is favourable for the accuracy of the strip thickness.

Other objects and advantages of the invention will become apparent from the following detailed description of embodiments thereof with reference to the accompanying drawings, in which.

Figure 4:
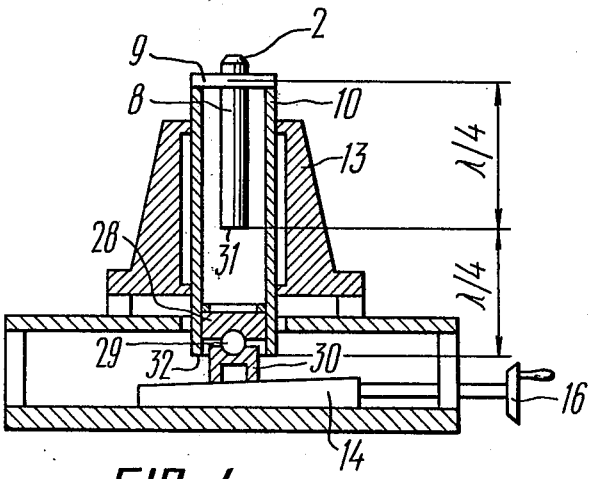
Figure 3:
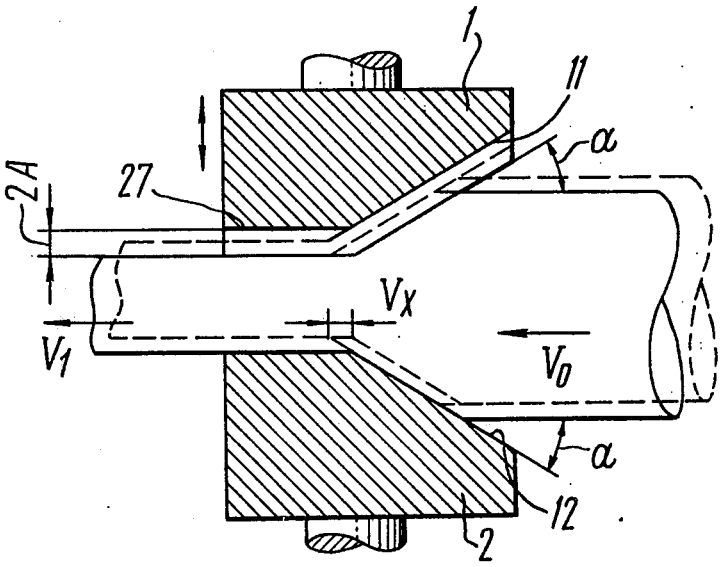

FIG. 3 diagrammatically shows the hammer and die-anvil with the wire being treated therebetween;

FIG. 4 shows an embodiment illustrating mounting of the anvil with a device for damping ultrasonic oscillations.

Figure 1:
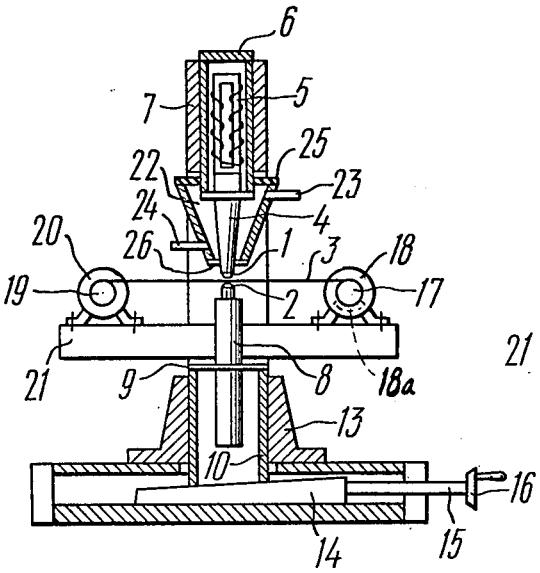
FIG. 1 shows a principle diagramatic front elevation of the apparatus according to the invention.
Figure 2:
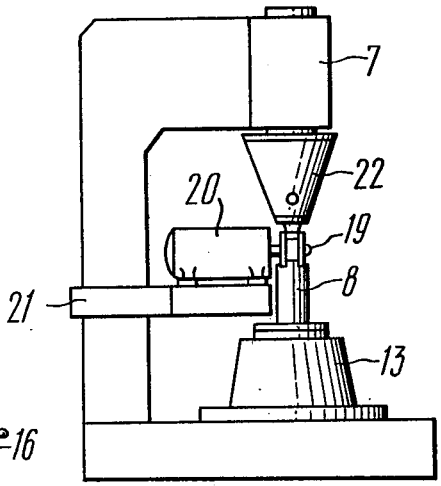
FIG. 2 is a diagrammatic side elevation of the apparatus according to the invention.

FIGS. 1 and 2 diagrammatically show the apparatus according to the invention. The apparatus comprises a hammer 1 and an anvil 2, and wire 3 to be treated placed therebetween.

The hammer 1 is mounted on an end face of an exponential concentrator 4 of ultrasonic oscillations of a length equal to one half of ultrasonic wavelength. The hammer 1 is mounted in the antinode zone of ultrasonic standing waves. The concentrator 4 of ultrasonic oscillations is soldered with a solid soldering alloy to a magnetostriction converter 5 accommodated in a casing 6. The casing 6 of the converter 5 is secured to a frame 7 of the apparatus. The converter 5 is supplied by an ultrasonic oscillator (not shown) having an output of $w=400$ W at $f=22$kHz. The anvil 2 is rigidly fixed to a metal rod 8 of a length equal to one quarter or one half of the wavelength of ultrasonic standing waves, and the rod is connected, by means of a flange 9 arranged at the intermediate part of the rod 8, that is at the node of the standing waves, to a metal sleeve 10. The selected length of the rod 8 provides for maintenance of the resonance standing waves in the system including the converter 5, the concentrator 4 and the hammer 1 thus ensuring reliable operation of the apparatus. Chamfers 11 and 12 at the angle $\alpha$ are provided on the hammer 1 and anvil 2 (FIG. 3) on the side of feeding of the wire 3. The sleeve 10 is accommodated in a hollow column 13 and is supported by a wedge 14 of a mechanism for adjusting the anvil position relative to the hammer 1.

The wedge 14 is connected, via a shaft 15 and a screw couple (not shown), to a handwheel 16. The wire 3 is wound on a feeding spool 17 which is mounted on a shaft on an a-c. electric motor 18. A band friction brake 18*a* is mounted on the other end of the shaft of the electric motor 18 to provide tensioning of the wire 3. The end of the wire 3 is fixed to a receiving spool 19 which is mounted on the shaft of a d-c. electric motor 20. The motors 18 and 20 are mounted to a support 21 suspended from the frame 7.

For cooling the concentrator 4 of ultrasonic oscillations and for maintaining its temperature within pre-set limits, a cooling system is mounted thereto. The cooling system comprises a tank 22 in the form of a truncated cone containing a coolant and provided with an inlet pipe 23 and an outlet pipe 24 for admission and discharge of the coolant. The concentrator 4 is accommodated within the tank 22 which is connected, at one side, to the casing 6 by means of a rubber washer 25, and at the other side, to the concentrator 4 by means of a washer 26.

The above-described apparatus functions in the following manner. The wire 3 being treated is wound on the spool 17 and mounted on the shaft of the electric motor 18 (FIG. 1). The spool 19 is mounted on the shaft of the electric motor 20, and the end of the wire 3, which is passed between the hammer 1 and the anvil 2, is fixed to the spool 19. Then, using the handwheel 16 and wedge 14 of the adjusting mechanism, the anvil 2 is urged against the hammer 1 until the wire 3 is clamped between the anvil 2 and the hammer 1. The electric motor 18 is energized, and a desired tensioning of the wire 3 is adjusted. In case the tensioning of the wire 3 is to be increased, the tape friction brake 18*a* is used which is mounted on the shaft of the electric motor 18. A coolant — water — for cooling the concentrator 4 is fed to the tank 22 via the pipe 23. Then the electric motor 20 and the ultrasonic oscillator (not shown) are energized, and the finished strip 3 is wound on the receiving spool 19. A desired spacing between the hammer 1 and anvil 2 is adjusted by using the handwheel 16 of the wedge 14 to provide for making strip of a preset thickness, while optimum speed of wire treatment is adjusted by varying the supply voltage of the electric motor 20, the speed being variable from 5 to 300 m/min.

Deformation of the wire 3 which is spread into strip occurs in the following manner. At a certain moment, the end face 27 of the hammer 1 (FIG. 3) is spaced apart from the tape upwards by an amount A of the amplitude of oscillations during one half-cycle of oscillations. The wire is urged against the chamfers 11 and 12 (FIG. 3) of the hammer 1 and anvil 2 under the action of the traction force imparted from the electric motor 20. During the next half-cycle of oscillations, the hammer 1 is displaced downwards, but now by the double amplitude of oscillations 2A since the end face 27 of the hammer is spaced apart from the central position by the amount A of amplitude of oscillations with every oscillation, and the total amount of displacement of the end face 27 is thus equal to the double amplitude of oscillations. The hammer 1 acts on the wire 3 to impart an impact load, and deformation of the wire 3 takes place at the chamfers 11 and 12 of the hammer 1 and anvil 2 by the same amount on either side (FIG. 3, dark portions). After the hammer 1 is spaced apart upwards at the double amplitude of oscillations, the wire 3 can be displaced at a distance "$V_x$" during the next time period. In the apparatus, this step is accomplished by the electric motor 20.

During next cycles of oscillations, the sequence of blows imparted by the hammer 1 is repeated, and since frequency of blows applied to the wire 3 is high, of the order of 20–23 kHz, the treatment is substantially continuous. Thus the speed of movement of wire during the spreading into strip is equal to $$V_o = \frac{A \cdot f}{tg\ \alpha}$$

wherein $V_o$ is speed of wire movement at the entrance of the deformation zone;

A is amplitude of oscillations of the hammer 1;

f is frequency of ultrasonic oscillations;

$\alpha$ is angle of chamfer of the hammer 1 and anvil 2 (in case of same angles of chamfer).

The speed of movement of the wire 3 leaving the deformation zone is:

$$V_l = \frac{A \cdot f \cdot \beta}{tg\ \alpha}$$

wherein $\int_3$ is the reduction ratio of metal in the deformation zone.

Therefore, the speed of wire movement with the steady performance is directly proportional to the amplitude and frequency of oscillations and inversely proportional to the tangent of chamfer angle, that is the greater the frequency and amplitude of oscillations and the smaller the angle of chamfer "$\alpha$", the greater the speed of wire movement. This speed determines the productivity of the process. It can achieve high absolute values, up to 300 m/min.

In practice, the speed of treatment is selected to be an optimum one for each specific application on the basis of strip and its thickness. Thus, the thinner the strip being produced and the lower the strength of metal (copper, aluminium), the lower the treatment speed which is selected, and vice versa, the thicker the strip being produced and the higher the strength of wire (molybdenum, rhenium and their alloys), the greater the speed of drawing of the wire and strip. Therefore, the apparatus can operate over a wide speed range.

Under the action of a rapidly applied impact load imparted by the hammer 1 to the wire 3, as well as under the concurrent action of ultrasonic elastic waves, the plasticity of metal of the wire 3 is improved and contact friction between the hammer 1 and the wire 3, and, respectively, between the anvil 2 and the wire 3 is reduced so that both soft and hard metals and alloys are deformed equally well. It is noted that no special heating or lubricating of wire in the deformation zone is required, and the surrounding gas medium does not affect quality of strip. This permits of obtaining a metal strip with the width-to-thickness ratio not less than 10.

FIG. 4 shows an embodiment of the apparatus having a device for damping ultrasonic oscillations induced in the anvil 2. The device comprises metal sleeve 10 which receives the metal rod 8 on the side of the flange 9 in such a manner that the upper end face of the rod 8 is aligned with the end face 9 of the sleeve 10. In this embodiment, the length of the rod 8 is equal to one quarter of ultrasonic wavelength, and the length of the sleeve 10 is equal to one half of ultrasonic wavelength. The sleeve 10 is closed at the bottom by a metal plug 28 through which the sleeve bears on a ball 29 mounted on a support 30. The support 30 is in its turn mounted on the wedge 14 of the mechanism for adjusting the position of the anvil 2.

During operation, the device for damping ultrasonic oscillations prevents ultrasonic standing wave from occuring at the fastening point of the anvil 2 (FIG. 4) thus eliminating oscillations in the anvil 2 and excluding the possibility of beat in the zone of deformation of the wire 3 which could otherwise occur upon adding of oscillations of the hammer 1 and anvil 2, so that the strip quality as regards thickness is improved. Difference in thickness along the strip when using this embodiment is less than units or tenths and even hundredths of micrometer (depending on the rated thickness of strip).

Ultrasonic oscillations induced in the anvil 2 and rod 8 under the action of the hammer 1 would result in unstable amplitude of oscillations of the end face of the anvil 2 so that intensity of oscillations transmitted to the anvil 2 depends on the degree of deformation of the wire 8, its microstructure and plasticity of the wire metal. Since the length of the rod 8 (FIG. 4) and the length of the sleeve 10 differ from each other by one quarter of the ultrasonic wavelength, the waves reflected from the lower end faces 31 and 32 return back to the zone of the anvil 2 with a phase shift of $\pi/2$ and are relatively damped. This damping of waves in the zone of the anvil 2 is favourable for reliable operation of the apparatus.

Therefore, the use of the apparatus according to the invention considerably simplifies the manufacturing process of making narrow strips of micron thickness (additional heating of wire prior to deformation into strip, special lubrication and gas medium, as well as cleaning of the strip from lubricants are dispensed with), and enables the production of narrow microstrips of high quality as regards both thickness and surface finish with high productivity.

For obtaining strips of various profiles in cross-section (square, triangular, oval and others), the hammer 1 and/or the anvil 2 may be provided with profiled grooves of corresponding shape.

I claim:

1. An apparatus for making metal tape from wire comprising: working tools - a hammer and an anvil; a metal rod which is vertically adjustable relative to said hammer, said anvil being mounted on an end face of the rod; a source of ultrasonic oscillations having a concentrator in contact with said hammer; the length of said rod being multiple to one quarter of ultrasonic wavelength; feeding and receiving spools for said wire and strip, respectively; a mechanism for tensioning said wire arranged between said spools.

2. An apparatus as claimed in claim 1, wherein there is provided a device for damping ultrasonic oscillations induced in the anvil during the manufacture of metal strip, said device comprising a metal sleeve receiving at one end face thereof said metal rod in such a manner that the upper end face thereof is aligned with the end face of the sleeve which is closed at the bottom by a metal plug, the length of said rod and the length of said sleeve differing from each other by an odd number of quarters of ultrasonic wavelength.

3. An apparatus as claimed in claim 2, wherein the sleeve is supported by means of the plug on an adjusting wedge for vertical displacement of the rod together with the anvil.

* * * * *